US007452318B2

(12) United States Patent
Gelli et al.

(10) Patent No.: US 7,452,318 B2
(45) Date of Patent: Nov. 18, 2008

(54) MACHINE AND METHOD FOR FORMING HELICALLY WOUND PAPER TUBES HAVING IMPROVED MECHANICAL RESISTANCE

(75) Inventors: Mauro Gelli, Lucca (IT); Mario Gioni Chiocchetti, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 2 days.

(21) Appl. No.: 10/554,406

(22) PCT Filed: May 7, 2004

(86) PCT No.: PCT/IT2004/000253

§ 371 (c)(1),
(2), (4) Date: Oct. 24, 2005

(87) PCT Pub. No.: WO2004/101265

PCT Pub. Date: Nov. 25, 2004

(65) Prior Publication Data

US 2007/0010387 A1 Jan. 11, 2007

(30) Foreign Application Priority Data

May 15, 2003 (IT) ..... FI2003-A0133

(51) Int. Cl.
*B31C 1/00* (2006.01)

(52) U.S. Cl. ..... 493/269; 493/276; 493/290; 493/299; 493/301; 493/304; 156/195; 156/431

(58) Field of Classification Search ..... 493/269, 493/290, 299, 288, 273, 276, 291; 156/430, 156/431, 195

See application file for complete search history.

(56) References Cited

U.S. PATENT DOCUMENTS

| | | | | |
|---|---|---|---|---|
| 2,250,430 | A * | 7/1941 | Wade | 493/301 |
| 2,489,503 | A | 11/1949 | Sampson et al. | |
| 2,776,698 | A * | 1/1957 | Kreger | 156/429 |
| 2,785,700 | A * | 3/1957 | Yovanovich | 138/144 |
| 3,150,575 | A | 9/1964 | Couzens et al. | |
| 3,220,320 | A | 11/1965 | Brigham | |
| 3,636,827 | A | 1/1972 | Lindberg | |

(Continued)

FOREIGN PATENT DOCUMENTS

| | | |
|---|---|---|
| DE | 823 608 | 12/1951 |

(Continued)

OTHER PUBLICATIONS

Patent Abstracts of Japan: Tokutome Shinichi, vol. 200, No. 003, Mar. 30, 2000 and JP 11-333219 A (Chisso Corp.), Dec. 7, 1999.

*Primary Examiner*—Thanh K Truong
(74) *Attorney, Agent, or Firm*—Breiner & Breiner, LLC

(57) ABSTRACT

A machine for producing a tubular product by helical winding of strips of web material including a mandrel and a winding member to helically wind the strips of web material around the mandrel is disclosed. To improve adhesion between the strips, at least one pressure member is provided, cooperating with the mandrel, disposed downstream or upstream of the winding member with respect to the direction of advance of the tubular product being formed on the mandrel. The pressure exerted by the pressure member promotes adhesion of the strips forming the product.

17 Claims, 7 Drawing Sheets

U.S. PATENT DOCUMENTS 3,942,418 A 3/1976 Smith
4,952,202 A * 8/1990 Itoh ..... 493/299
5,251,809 A * 10/1993 Drummond et al. ..... 229/202
5,468,207 A 11/1995 Bower et al.
5,873,806 A 2/1999 Biagiotti
6,659,152 B1 * 12/2003 Miyake ..... 156/555

FOREIGN PATENT DOCUMENTS

DE 295 03 127 U1 6/1996
JP 59-9044 1/1984

* cited by examiner

MACHINE AND METHOD FOR FORMING HELICALLY WOUND PAPER TUBES HAVING IMPROVED MECHANICAL RESISTANCE

TECHNICAL FIELD

The present invention relates to a corewinder, that is, a machine or device used to produce tubular products from strips of web material wound helically about a mandrel and glued to form the finished product.

The invention also relates to a method for producing tubular products of the aforesaid type.

STATE OF THE ART

In the production of rolls of web material, for example rolls of toilet paper, rolls of kitchen towels, rolls of non-woven fabric, rolls of adhesive tape, plastic film, metalized film or the like, tubes of cardboard or another material are commonly utilized as winding cores, obtained by overlapping and staggered winding of at least two strips of web material bonded together. Winding is performed by machines called corewinders, which have a forming mandrel (fixed or supported idle about its axis) about which strips of web material previously provided with a layer of glue are wound. Usually, winding is obtained by means of a winding member, typically a continuous belt, which forms a helical turn about the mandrel and causes the strips of web material to be drawn and wound. The winding member provides thrust to the helically wound strips, to form the tubular product and make it advance along the winding mandrel.

Examples of machines of this type are described in the U.S. Pat. Nos. 3,150,575; 3,220,320; 3,636,827; 3,942,418; 5,468,207; 5,873,806.

The strips of web material are wound continuously and form a continuous tube, which is then cut into sections of the required length by means of cutting members disposed along the tube being formed.

The continuous belt utilized to obtain winding of the turns of web material is of a lesser width than the width of the strips of said material. The purpose of this is to prevent the glue, extruding along the edges of the turns by pressure exerted by the belt, from soiling said belt. This means that in the area in which it is required most, the pressure exerted is insufficient to obtain reciprocal adhesion of the overlapping turns of the two or more strips forming the tube.

One of the problems encountered in the production and subsequent use of these tubes consists in the fact that the quality of gluing between the helical strips of web material is not always sufficient to maintain the integrity of the tube. In fact, the tubular product may break while traveling along the forming mandrel if gluing is not sufficient to stabilize the turns being formed on said mandrel. Another critical point in the formation of tubular products is encountered in the area in which the continuous tubular product is cut into sections. Also in this area there may be problems of adhesion of the glue with consequent deterioration or localized breakage of the product.

Even when the product comes out of the corewinder in integral conditions, imperfect gluing of the strips forming it may give rise to further drawbacks during use of the tubes as winding cores for rolls.

In fact, in many applications, for example in the production of rolls of toilet paper or kitchen towels, the rolls that are wound on the tubular cores must subsequently be cut crosswise to their axes into small rolls of an axial length equal to the axial dimensions of the finished product. In the saw machines that are utilized for this purpose drawbacks occur frequently due to the fact that the knife making the cut, interfering with the strips of web material forming the tubular winding core, cause partial breakage thereof. Breakage takes place at the level of the cutting plane, where the blade intersects the edge of the innermost strip of web material. The stress applied by the blade, due to friction, causes partial detachment of the strip of web material from the tubular inner wall of the winding core. This breakage is unacceptable to the manufacturers of rolls, as it has a negative effect on the appearance of the finished product. To a certain extent, it may also constitute a functional drawback in the finished product, as it impedes insertion onto the dispensing device.

Other problems that can occur in the production of tubes are recognized in the fact that the poor quality of adhesion between overlapping strips makes it necessary to operate the corewinder at a lower speed with respect to its maximum design speed, with consequent decrease in productivity, that tubes cannot withstand the high speeds reachable by the rewinding machine employing them, and that tubes may be damaged during storage, that is while being stored between the corewinder and the rewinding machine utilizing them.

OBJECTS AND SUMMARY OF THE INVENTION

The object of the present invention is to produce a corewinder that overcomes the drawbacks mentioned above making it possible to obtain a tubular product, which has greater resistance and in particular improved reciprocal adhesion of the helical strips of which it is formed, allowing high production speeds and greater efficiency in the production cycle to be reached.

According to a further aspect, the object of the present invention is to produce a method making it possible to obtain with a corewinder a more resistant tubular product, in particular characterized by improved reciprocal adhesion of the helical strips of web material forming the tubular product.

These and other objects and advantages, which shall be apparent to those skilled in the art by reading the text hereunder, are obtained essentially with a corewinder, that is, a machine for producing a tubular product by helically winding strips of web material, comprising a mandrel and a winding member to helically wind strips of web material about said mandrel, provided with at least one pressure member cooperating with said mandrel, associated with the mandrel and disposed along the path of advance of the tubular product being formed on said mandrel, the pressure exerted by said pressure member promoting adhesion of the strips forming the product. The pressure member may be positioned either downstream of the winding member or winder, or upstream of it, where the turns of web material are formed. When the pressure member is positioned upstream of the winder problems of friction of the strips of web material on the mandrel are reduced.

According to an advantageous embodiment of the invention, the pressure member may comprise a wheel and an actuator to push the wheel and the mandrel against each other. Alternatively, two wheels may be also provided, acting in different areas of the tubular product being formed, for example and advantageously at the level of the helical line formed by the adjacent edges of the outermost strip and of the innermost strip, respectively, forming the tubular product. In this way adhesion of the turns along the outer surface and also along the inner surface of the product is improved, with advantages during production of the rolls that are wound on the sections of the tube formed and subsequently cut into small rolls with a lesser axial length.

When the pressure member has one or more wheels, the circular edge of said wheel or of each or said wheels is advantageously and preferably disposed with an inclination, with respect to the axis of the mandrel, essentially equal to the inclination of the helical winding of said strips of web material.

To increase the localized pressure applied by the wheel, this may be equipped with projections or protuberances. For example, annular projections or protuberances may be provided, although preferably protuberances in the form of teeth, analogous to the teeth of a gear, will be provided.

When the pressure member has two wheels, these may be disposed advantageously so as to reduce or eliminate the need to provide auxiliary supports for the mandrel, that is, so that one wheel provides the reaction force required to support the mandrel against the stress applied to the other wheel. For example, the two wheels may be positioned staggered by around 180° about the axis of the mandrel and in a position whereby the straight edge that unites their contact points with the tubular product being formed on the mandrel is more or less orthogonal to the axis of the mandrel and intersects it.

Further advantageous characteristics and embodiments of the machine according to the invention are indicated in the accompanying dependent claims and shall be described with reference to the examples of embodiment.

According to a different aspect, the invention also relates to a method for producing a tubular product wherein at least a first strip and a second strip of web material, staggered with respect to each other, are helically wound about a winding mandrel by means of a winding member, the two strips being glued to each other. Characteristically, according to the invention, pressure is applied to the outer surface of the tubular product being formed about said mandrel, downstream of said winding member to stabilize adhesion between said two strips. This pressure is advantageously applied for example around the joining line between adjacent turns of the first strip of web material, forming the outermost layer of the tubular product. Alternatively, or in combination, said pressure may be applied to the outer surface of the tubular product at the level of the joining line between adjacent turns of the second strip of web material, forming an inner layer of the tubular product.

BRIEF DESCRIPTION OF THE DRAWINGS

The invention shall be better understood with reference to the description hereunder and to the accompanying drawings, showing a non-limiting practical embodiment of the invention. In the drawing, where equivalent or corresponding parts are indicated with the same reference numerals.

DETAILED DESCRIPTION OF THE PREFERRED EMBODIMENTS OF THE INVENTION

Figure 1:
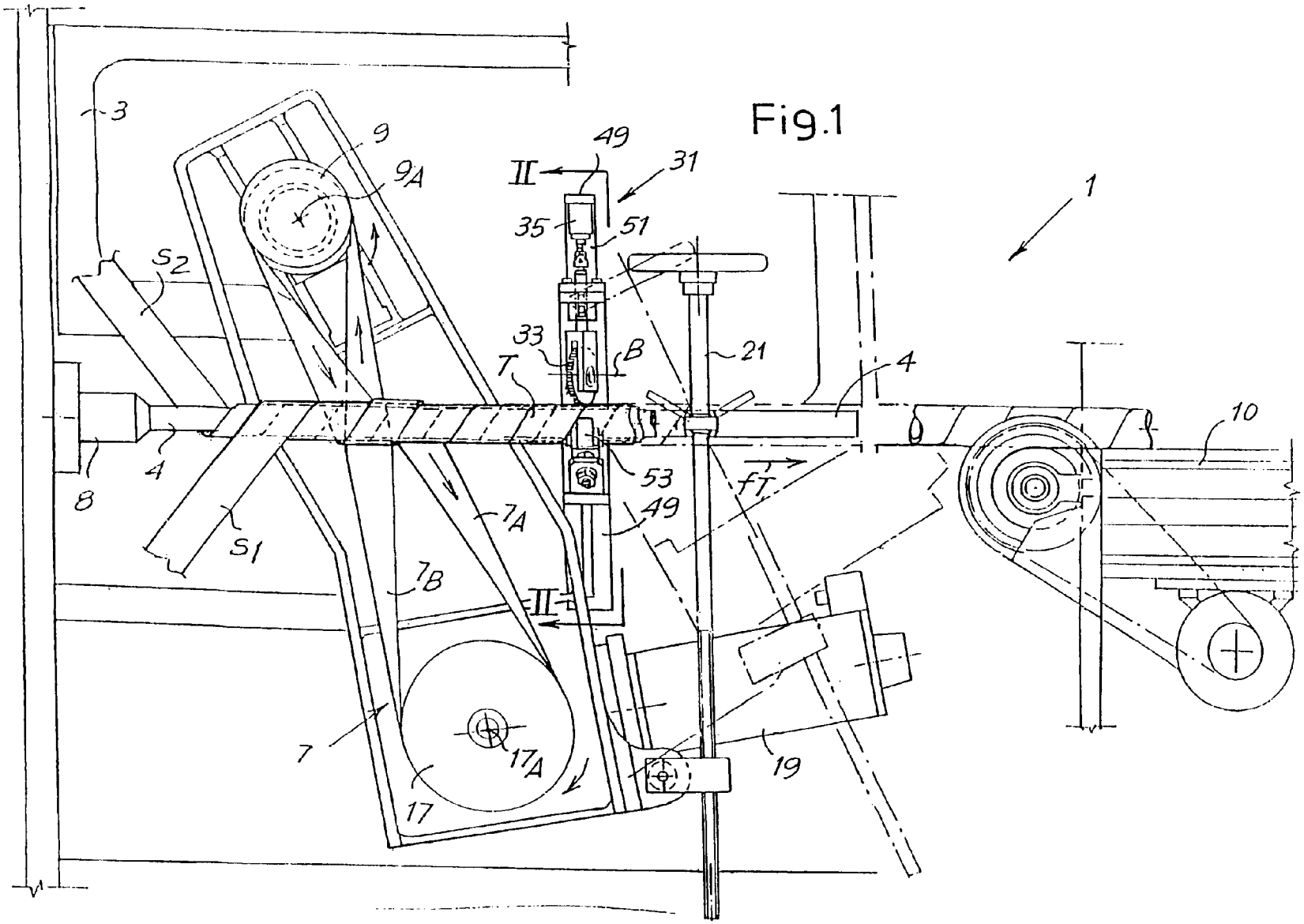
FIG. 1 shows a side view of a machine according to the invention.

FIG. 1 shows as a whole a corewinder to which the present invention is applied. The machine shown has a structure corresponding essentially to the one described in the U.S. Pat. No. 5,873,806, which should be referred to for a detailed description of the components of the machine, not of interest in the description of the present invention. In particular, the cutting members of the continuous tube, which may be produced as in the aforesaid US patent or in any other suitable way, are not shown.

It must also be understood that the invention may also be applied to machines with a different structure, as long as they are provided with a forming mandrel to form the tubes, which may either be fixed or rotating about its axis.

Briefly, and limited to the parts of interest in the present description, the machine in FIG. 1, indicated as a whole by 1, comprises a load-bearing structure 3 from which a mandrel 4 is supported in a cantilever fashion, a first end thereof being constrained to the load-bearing structure 3 by means of a sleeve 8. The opposed end of the mandrel 4 terminates in proximity to the cutting area or to a conveyor belt 10 onto which the individual tubular products obtained by cutting a tube T, formed continuously as described hereunder about the mandrel 4, are unloaded. The cutting system that divides the tube into sections is not shown and is per se known.

To form the tube T, two continuous strips of cardboard or of another continuous web material indicated with S1 and S2, are fed to the corewinder 1. These are wound helically about the mandrel 4 with the aid of a continuous belt 7, which has two branches 7A and 7B, driven about two pulleys 9 and 17, of which 9A and 17A indicate the respective axes of rotation. The branch 7A forms a helical turn about the mandrel 4 and about the strips of web material S1 and S2 being wound. The numeral 19 indicates the motor which draws the driving pulley 17 in rotation, causing movement of the belt 7.

Inclination of the assembly formed of the pulleys 9, 17, of the belt 7 and of the motor 19 is adjustable by means of a threaded bar 21 and a handwheel 23, so as to adjust inclination of the helical turns formed by the two strips S1, S2 about the axis of the mandrel 4.

The two strips S1 and S2 are wound overlapping and staggered, so that a helix formed by the turns of the outermost strip S1 overlaps a helix formed by the turns of the innermost strip S2. The two turns are staggered so that the joining lines between adjacent turns of the innermost helix are covered by the turns of the outermost strip. The two strips may, for example, be staggered by half a pitch.

A glue is applied to the inner surface of the outer strip S1 and/or to the outer surface of the inner strip S2 in a way per se known and not shown, to make the two turns adhere to each other. As mentioned hereinbefore, the width of the belt 7 is lesser than the width of the strips S1, S2 to prevent the glue from soiling it.

Figure 4:
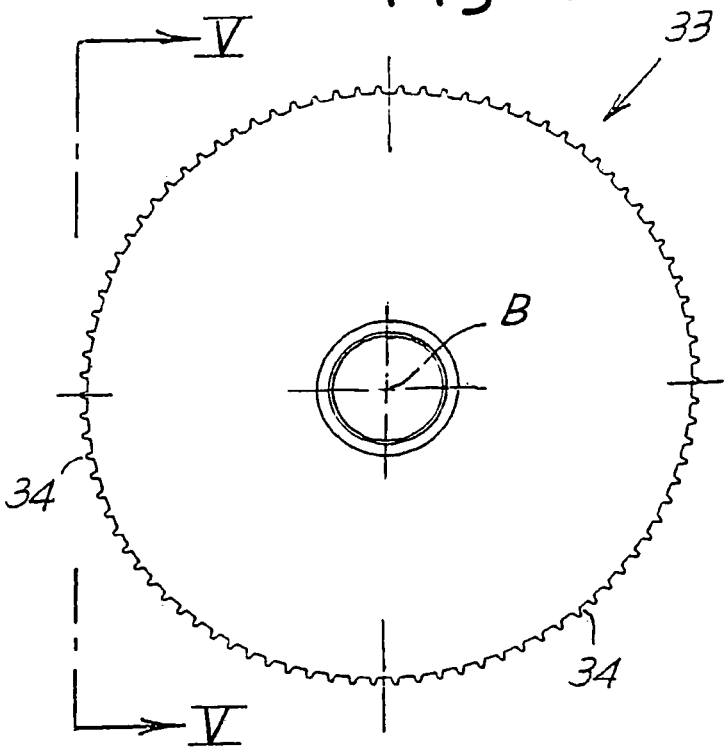
FIG. 4 shows a side view of the wheel of the machine in FIGS. 1 to 3.
Figure 5:
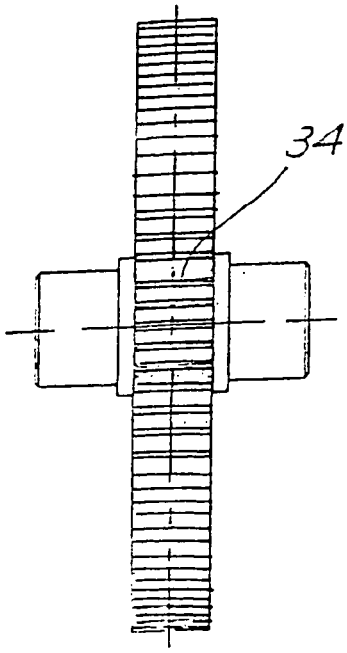
FIG. 5 shows a side view according to V-V in FIG. 4.

Along the extension of the mandrel 4, disposed downstream of the winding member of the strips S1, S2, formed by the belt 7, is a pressure member indicated as a whole with 31, comprising a toothed or knurled wheel 33, shown in detail in FIGS. 4 and 5. As can be seen in these figures, the circular perimeter of the wheel 33 is provided with teeth or protuberances 34 parallel to the axis of rotation of the wheel. It must be understood that the arrangement of the teeth 34 may differ from the one shown. For example, the teeth 34 may be inclined analogously to the teeth of a helical gear. Yet again, they may not be continuous, but rather discontinuous, or may have a concave frontal surface. Generally, the teeth may have a concave profile, so as to produce a larger contact area with the tube T being formed, even to have contact on more or less the entire extension of the tooth. In this way the helical band in which the wheel exerts its action on the tube T is increased.

The wheel 33 is supported with its axis B inclined with respect to the axis A of the mandrel 4. The degree of inclination is such that it rolls on the tube T being formed about the mandrel along a line that has essentially the same inclination as the turns formed by the strips S1 and S2. Inclination of the axis of the wheel 33 is adjustable, as is inclination of the turns formed by the strips S1 and S2. The position of the wheel 33 with respect to the area of formation of the turns of strips S1, S2 forming the tube is adjusted so that the wheel is in contact with the outer surface of the tube at the level of the line separating two adjacent turns formed by the outermost strip S1. In this way the wheel 33 exerts pressure along a helical band overlapping the helical line defined by the juxtaposed edges of adjacent turns of the strip S1.

The pressure exerted by the wheel may have a dual effect of stabilizing the turns forming the tube T. On the one hand, the pressure increases the adhesion implemented by the glue applied between the two strips. On the other, high pressure may also provide an additional effect of ply-bonding between the overlapping strips S1 and S2.

Figure 2:
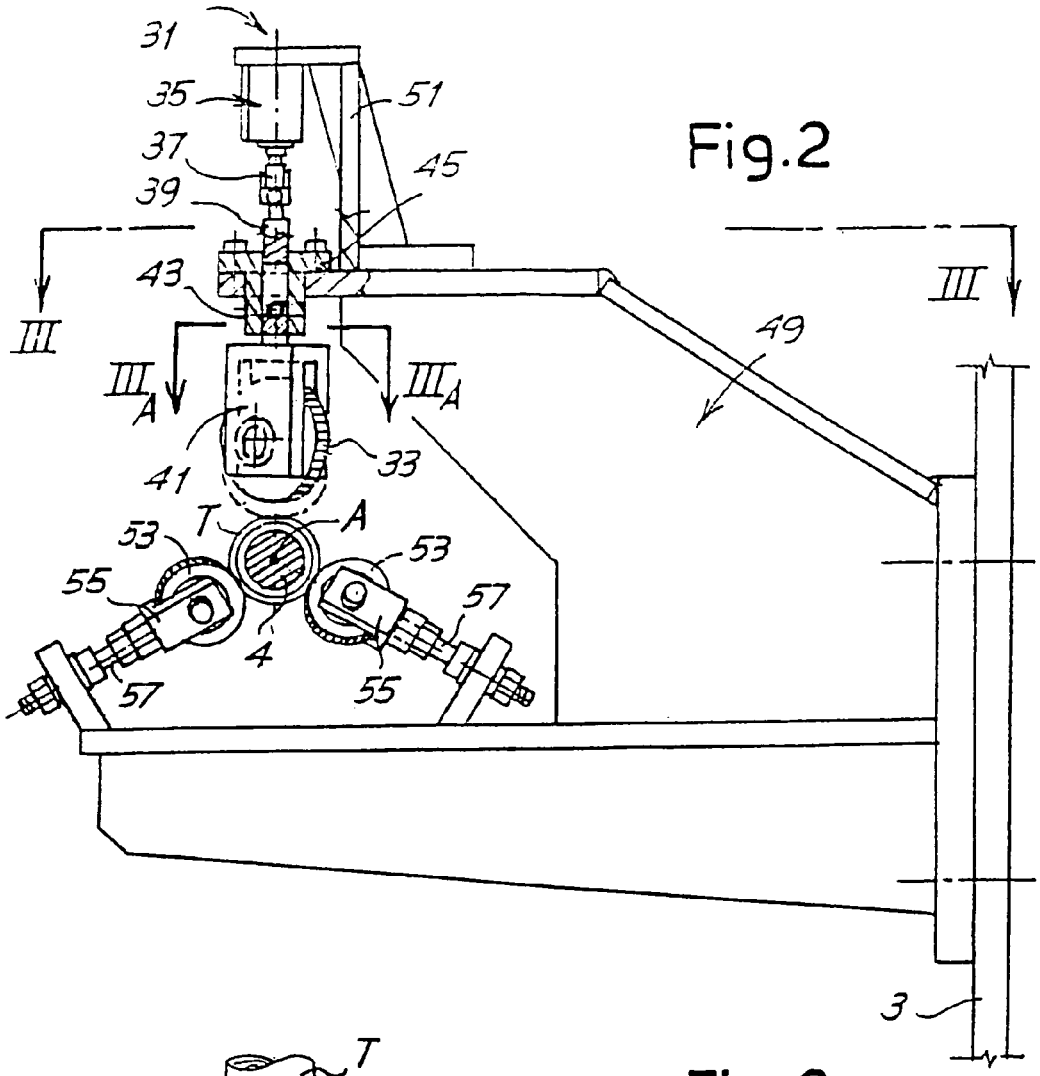
FIG. 2 shows a local section according to II-II in FIG. 1.

The pressure with which the wheel 33 acts against the outer surface of the tube T being formed is provided by a piston-cylinder actuator 35, the stem 37 of which is constrained to a supporting rod 39 (FIG. 2) integral with a supporting member 41 of the wheel 33. The supporting rod 39 slides freely in a sleeve 43 and is torsionally constrained to the latter. For this purpose the rod 39 may have a non-circular cross-section and the sleeve 43 may have a through hole corresponding in shape. Or, as in the example shown, the supporting rod 39 may have a slotted through hole, elongated according to the direction of the axis of said rod, inside which a transverse pin, integral with the sleeve 43, engages.

Figure 3:
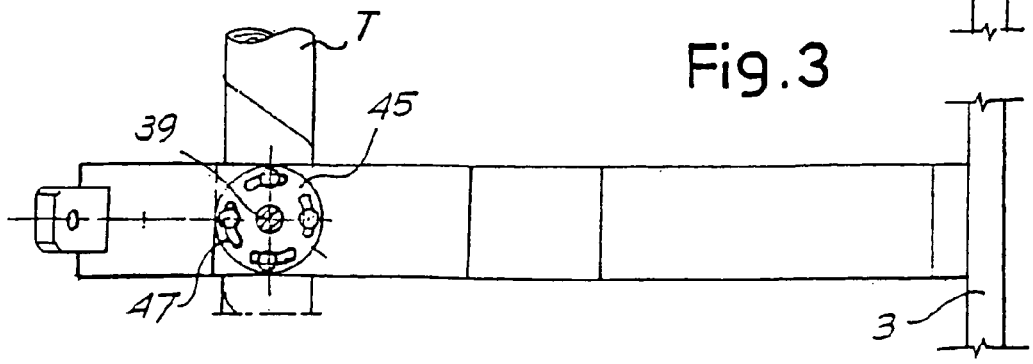
FIG. 3 shows a local section according to III-III in FIG. 2.
Figure 3A:
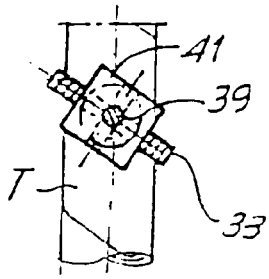
FIG. 3A shows a local section according to IIIA-IIIA in FIG. 2.

The sleeve 43 has a flange 45 equipped with slotted holes 47 (see in particular FIG. 3), by means of which said sleeve may be fixed, in an angularly adjustable position, to a supporting structure 49, integral with the structure 3. A bracket 51, to which the body of the piston-cylinder actuator 35 is constrained, is also fixed rigidly to the support 49.

The actuator 35 can press the wheel 33 against the mandrel 4 even with a relatively high force. To provide sufficient reaction and supporting force to the mandrel, under the wheel 33, in this embodiment, two rests are provided, composed of two rollers 53 carried idle by supports 55 integral with pins 57 fixed to the structure 49. The pins are angularly adjustable so that the rollers 53, just as the wheel 33, can be inclined so as to roll on the cylindrical surface of the tube T being formed along a helical line with the same inclination as the strips S1, S2 forming said tube. In this way rubbing between the rollers and the tube T is prevented. As can be seen in particular in FIG. 1, the rollers 53 and the wheel 33 are disposed in the space so that the contact points of these members with the tube T being formed about the mandrel 4 lie on a plane essentially orthogonal to the axis A of the mandrel 4, to prevent moment stresses on said mandrel.

With the layout described hereinbefore, the corewinder operates as follows. The strips S1, S2 are fed continuously and wound about the mandrel 4, which may be a fixed mandrel or mounted idle to rotate about its axis. Alternatively and in a known way the mandrel may be in part fixed and in part idle. The staggered turns formed by the two strips S1, S2 are pressed against each other by the belt 7 to stabilize reciprocal gluing of the strips wound in a spiral and form the continuous tube T. This advances according to the arrow fT rotating about itself towards the cutting means disposed along the path of the tube and not shown, to be cut into sections of the required length. When the tube T passes through the pressure member 31, the wheel 33 applies high pressure by means of the protuberances 33 thereof along the edge area of the outer turns formed by the strip S1, to obtain better stability and resistance of the tubular product. The pressure improves bonding of the strips through the effect of the glue, and, if necessary, with adequate pressure values add characteristics of the cardboard or other material forming the strips S1, S2, ply-bonding may be obtained.

Figure 6:
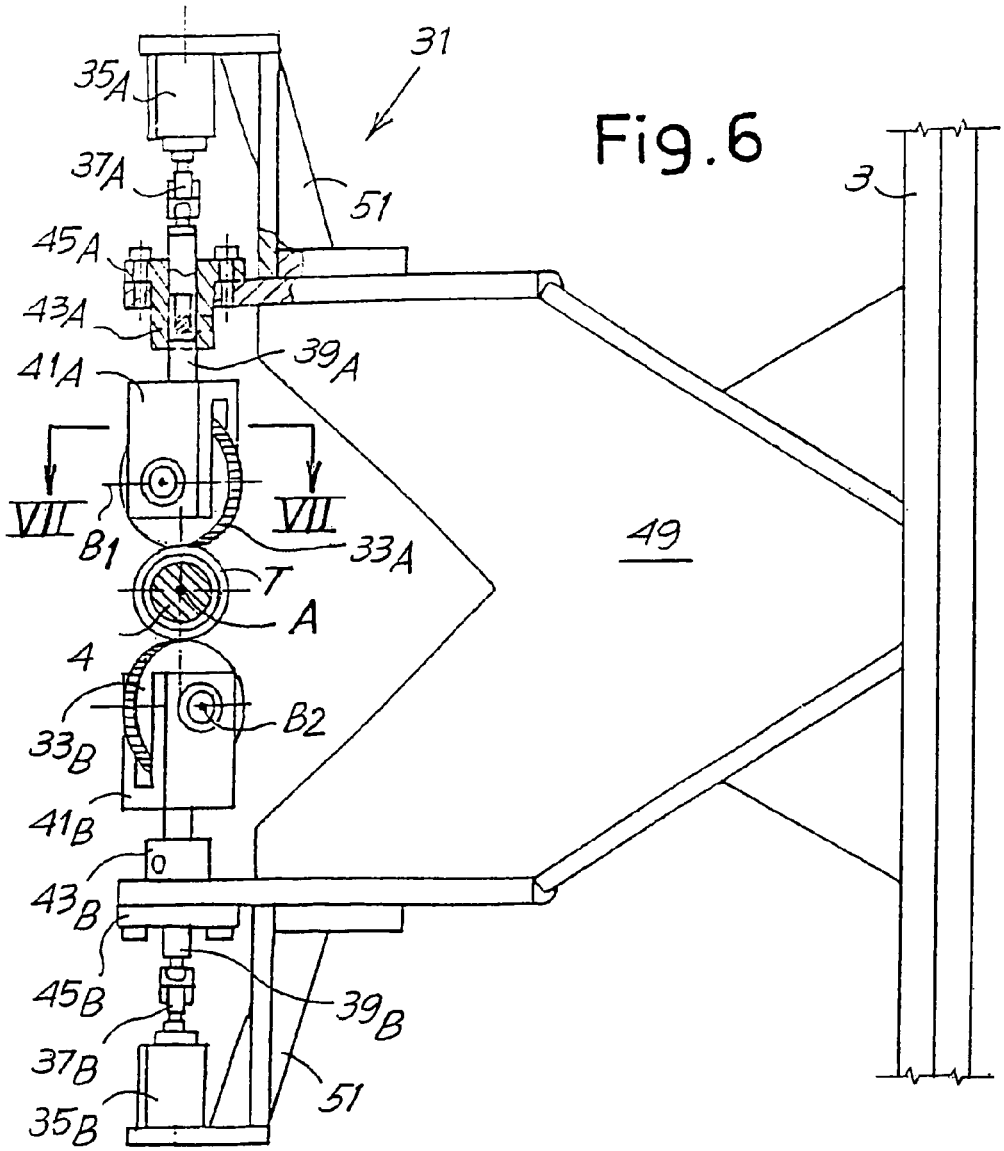
FIG. 6 shows a local section analogous to the section in FIG. 2, in a modified embodiment of the invention.
Figure 7:
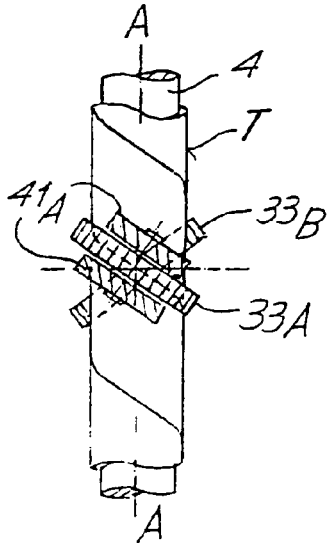
FIG. 7 shows a section according to VII-VII in FIG. 6.
Figure 8:
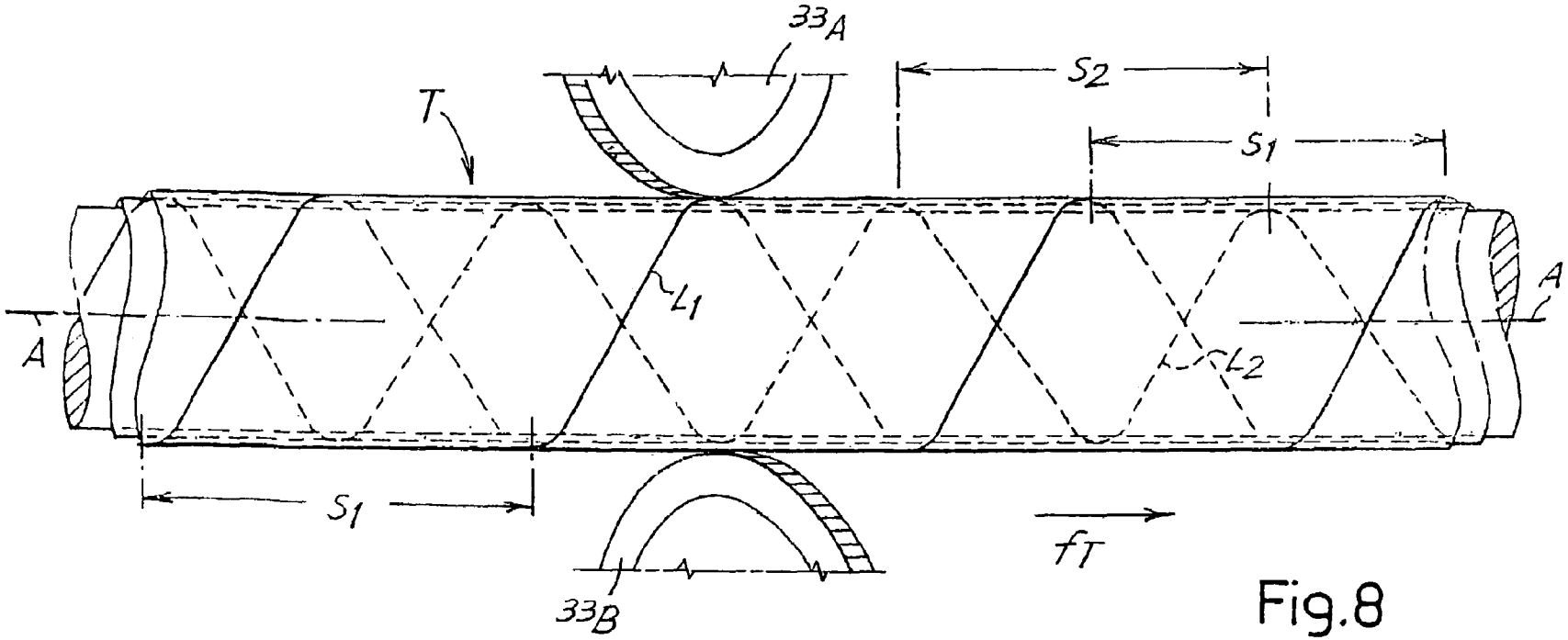
FIG. 8 shows a side view of the wheels and of the tube being formed in the arrangement in FIGS. 6 and 7.

To obtain improved bonding of the strips forming the tube T also at the level of the helical line defined by the juxtaposed edges of the inner turns, formed by the strip S2, in an improved embodiment of the corewinder according to the invention, shown in FIGS. 6 to 8, is provided with a pressure member equipped with two wheels rather than a single wheel.

In fact, in this case the pressure member, once again indicated with 31, comprises two wheels 33A, 33B, each of which may be produced like the wheel 33 shown in FIGS. 4 and 5. The two wheels 33A, 33B, of which B1 and B2 indicate the respective axes of rotation, are carried by supports 41A, 41B and rods 39A, 39B, guided in sleeves 43A, 43B equipped with flanges 45A, 45B. The numerals 35A, 35B and 37A, 37B indicate the piston-cylinder actuators and relative rods, constrained to the brackets 51 of the load-bearing structure 49, which press the two wheels against the mandrel 4 and the tube T being formed about it.

The two wheels are superimposed so that the stresses applied to the mandrel are cancelled out. This makes it unnecessary to provide further supports for the mandrel. However, the wheels may also be disposed differently and combined with supports analogous to the rollers 53 of the previous embodiment or other equivalent supports.

As can be observed in the schematic representation in FIG. 8, the wheel 33A is disposed so as to act with its projections or protuberances 34 in a helical band along the joining line L1 defined by adjacent edges of consecutive turns formed by the outer strip S1. Therefore, it performs the same function as the wheel 33 of the example shown in FIGS. 1 to 3A. The wheel 33B is positioned and inclined so that it acts on the outer surface of the strip S1 at the level of the line L2 defined by the juxtaposed edges of two adjacent turns formed by the inner strip S2.

This layout thus allows high pressure to be applied along the helical edge lines of the strips S1, S2, both on the outer surface and on the inner surface of the tube T, improving the quality of the product. This advantage is essentially obtained without any increase in construction, as the additional wheel means that the reaction supports formed by the rollers 53 are no longer required. A single actuator 35A may even be provided, eliminating the actuator 35B and providing a simple, angularly adjustable support for the lower wheel 33B (or, vice versa, for the upper wheel).

However, the advantage of increased resistance in the finished product may also be obtained by placing the wheels 33A, 33B in angularly different positions to the one shown with respect to the axis A of the mandrel 4. In this case, auxiliary supports analogous to the rollers 53 may be provided.

Figure 9:
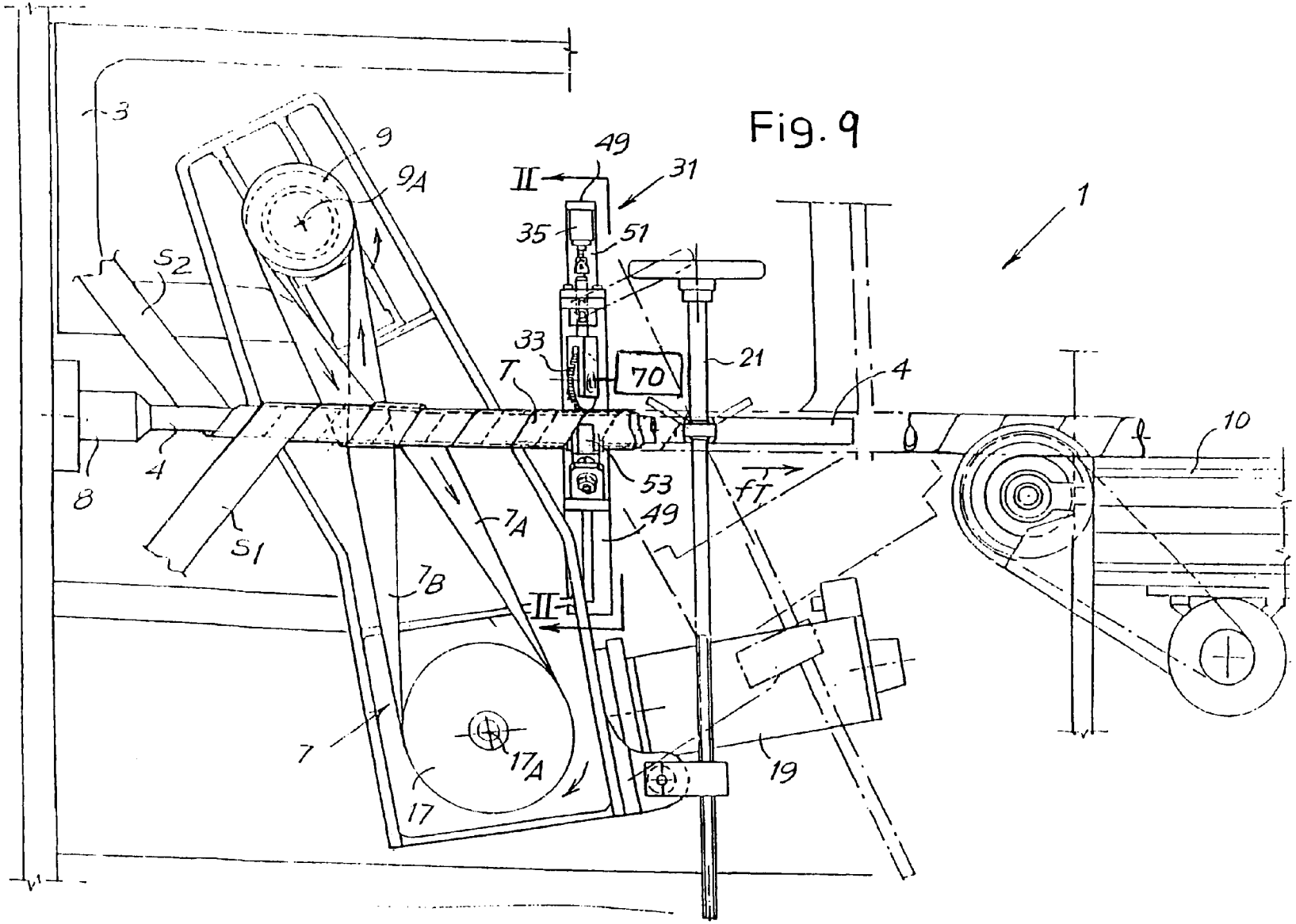
FIG. 9 shows a side view of a second embodiment of a machine according to the invention.

In both the examples illustrated the wheel(s) 33; 33A, 33B may be motorized by a motor 70, such as shown for example in FIG. 9, to provide a thrust on the tube that facilitates its advance along the mandrel 4.

Figure 10:
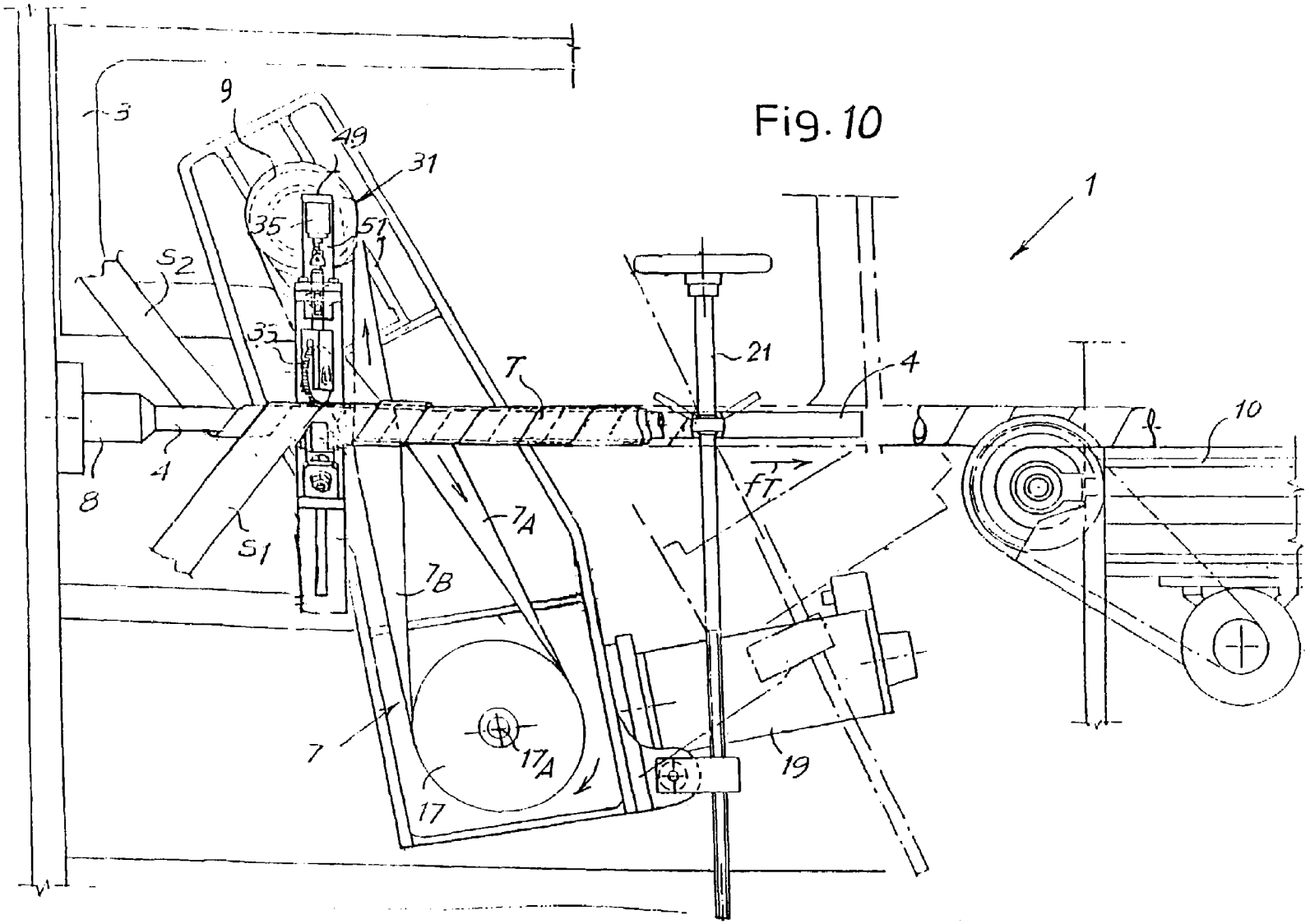
FIG. 10 shows a side view of a third embodiment of a machine according to the invention.

In the examples shown the wheel(s) constituting part of the pressure member is/are disposed downstream of the winding member, that is, of the belt 7. Nonetheless, the wheel(s) may also be disposed upstream of the belt, in the area in which the turns formed by the strips S1 and S2 start to form, such as shown for example in FIG. 10.

Moreover, the pressure member may be constrained to the support on which the motor 19, the pulleys 9 and 17 and the belt 7 are disposed, rather than directly to the fixed structure 3 of the machine.

When the tubular product is formed with partial overlapping of the turns formed by the strips of web material, the wheel(s) may in any case be disposed at the level of one edge of the respective strip.

It is understood that the drawing merely shows a practical embodiment of the invention, which may vary in forms and layouts without however departing from the scope of the concept on which the invention is based. Any reference numerals in the appended claims are provided purely to facilitate reading in the light of the description hereinbefore and of the accompanying drawings, and do not limit the scope of protection whatsoever.

The invention claimed is:

1. A machine for producing a tubular product by helical winding and gluing of strips of web material, comprising a mandrel, a winding member constructed and arranged to helically wind in an overlapping and staggered manner at least two strips of web material around said mandrel to form a tubular product, at least one pressure member cooperating with said mandrel and, in combination with said winding member, disposed along a path of the tubular product being formed on said mandrel, wherein pressure exerted by said pressure member promotes adhesion of the strips forming the tubular product, wherein said at least one pressure member comprises at least one wheel and an actuator to stress the at least one wheel and the mandrel against each other, wherein said at least one wheel is carried by a support arranged to slide in a sleeve and torsionally constrained to said sleeve, wherein said sleeve is arranged to be locked in an angularly adjustable position with respect to a fixed load-bearing structure, wherein said sleeve comprises a flange with slotted holes to lock said sleeve in said angularly adjustable position.

2. The machine as claimed in claim 1, wherein said at least one wheel is positioned to act on an outer surface of the tubular product at a level of an edge line of adjacent turns of an outermost strip of web material forming the tubular product.

3. The machine as claimed in claim 2, wherein said wheel includes a circular edge disposed at an inclination, with respect to an axis of the mandrel, essentially equal to an inclination of a helical winding of said at least two strips of web material.

4. The machine as claimed in claim 3, wherein the circular edge of said wheel has a series of protuberances.

5. The machine as claimed in claim 4, wherein said protuberances comprise teeth.

6. The machine as claimed in claim 3, wherein inclination of an axis of rotation of the wheel is adjustable with respect to the axis of the mandrel.

7. The machine as claimed in claim 1, wherein said at least one pressure member comprises at least one supporting element for said mandrel.

8. The machine as claimed in claim 7, wherein said at least one pressure member comprises two angularly staggered supporting elements arranged to provide the mandrel with a reaction force to stress applied by said at least one wheel.

9. The machine as claimed in claim 8, wherein contact points between said at least one wheel and the tubular product being formed on the mandrel and between said at least one supporting element and said tubular product lie approximately on a plane orthogonal to an axis of the mandrel.

10. The machine as claimed in claim 1, wherein said at least one wheel is motorized.

11. The machine as claimed in claim 1, wherein said pressure member is positioned downstream of the winding member.

12. The machine as claimed in claim 1, wherein said pressure member is positioned upstream of the winding member.

13. The machine as claimed in claim 1, wherein the at least one pressure member further comprises:

at least one supporting element for the mandrel, contrasting an action of the at least one wheel, wherein the at least one wheel and the supporting member are arranged around the mandrel such that the tubular product advances between the mandrel and the at least one wheel and the supporting element.

14. The machine as claimed in claim 1, wherein said winding member comprises a belt forming a helical turn about the mandrel and about the strips being wound around the mandrel.

15. The machine as claimed in claim 1 or 14, wherein said pressure member comprises two wheels acting on the tubular product being formed around said mandrel.

16. The machine as claimed in claim 15, wherein said two wheels are arranged to act on an outer surface of the tubular product, a first wheel of said two wheels at a level of a joining line of adjacent turns formed by an outermost strip of web material and a second wheel of said two wheels at a level of a joining line of adjacent turns formed by an innermost strip of web material.

17. The machine as claimed in claim 15, wherein said two wheels are disposed staggered by about 180° around an axis of the mandrel and in a position wherein a straight line uniting contact points of the two wheels with the tubular product being formed on the mandrel is approximately orthogonal to the axis of the mandrel.

* * * * *